US006022198A

United States Patent [19]

Hoffmeister

[11] Patent Number: 6,022,198

[45] Date of Patent: Feb. 8, 2000

[54] TWIN PUMP WITH A CHARGING PUMP

[75] Inventor: Hermann Hoffmeister, Nersingen, Germany

[73] Assignee: Brueninghaus Hydromatik GmbH, Elchingen, Germany

[21] Appl. No.: 09/011,390

[22] PCT Filed: Aug. 12, 1996

[86] PCT No.: PCT/EP96/03562

§ 371 Date: Feb. 6, 1998

§ 102(e) Date: Feb. 6, 1998

[87] PCT Pub. No.: WO97/13065

PCT Pub. Date: Apr. 10, 1997

[30] Foreign Application Priority Data

Oct. 4, 1995 [DE] Germany ..... 195 36 997

[51] Int. Cl.[7] ..... F04B 23/14

[52] U.S. Cl. ..... 417/203; 417/269; 417/238; 417/350; 417/199.1; 417/370; 417/429; 74/15.86

[58] Field of Search ..... 417/203, 205, 417/269, 238, 370, 236

[56] References Cited

U.S. PATENT DOCUMENTS

| | | | |
|---|---|---|---|
| 2,910,008 | 10/1959 | Weisenach . | |
| 3,644,067 | 2/1972 | Yowell | 417/370 |
| 4,014,628 | 3/1977 | Ruseff et al. . | |
| 5,183,392 | 2/1993 | Hansen | 417/203 |
| 5,800,134 | 9/1998 | Hasegawa et al. | 417/269 |

FOREIGN PATENT DOCUMENTS

| | | |
|---|---|---|
| 1453427 | 10/1970 | Germany . |
| 2515785 | 10/1975 | Germany . |
| 2720134 | 11/1978 | Germany . |
| 3018711 | 2/1981 | Germany . |
| 3324583 A1 | 1/1984 | Germany . |
| 4225380 A1 | 2/1994 | Germany . |
| 8028444 | 1/1996 | Japan . |

*Primary Examiner*—John A. Jeffery
*Assistant Examiner*—Leonid Fastovsky
*Attorney, Agent, or Firm*—Scully, Scott, Murphy & Presser

[57] ABSTRACT

A double pump unit including two hydraulic pumps (1, 2) having drive shafts (5, 6) arranged coaxially with one another, which shafts are coupled with one another in a force-locking manner by a coupling piece (23). The coupling piece (23) is integrated in a connection piece (26) at least partially surrounding the coupling piece, in which connection piece there are formed suction channels (19, 20) for drawing in the pressure medium to be delivered through the hydraulic pumps (1, 2). The connection piece (26) has an inlet pressure chamber (33) into which the suction channels (19, 20) open. Further, the coupling piece (23) has peripherally arranged blade elements (30, 31) which rotate in the inlet pressure chamber (33) in order to feed the pressure medium into the suction channels (19, 20) under an initial pressure. The connection piece (26) may also be formed in two parts and, along with a main body (27), have a lid-like closure part (29) which is so dimensioned that the coupling piece (23), with its blade elements (30, 31), can be introduced into the main body (27) of the connection piece (26) through an opening (34) which can be closed by the closure piece (29).

10 Claims, 2 Drawing Sheets

TWIN PUMP WITH A CHARGING PUMP

BACKGROUND OF THE INVENTION

1. Field of the Invention

The invention relates to a double pump unit having two hydraulic pumps with drive shafts coaxially arranged and coupled to each other through the intermediary of a coupling piece, in a force-locking manner.

2. Discussion of the Prior Art

Such a double pump unit is known from DE-OS 33 24 583. The known double pump unit has two hydraulic pumps having drive shafts arranged coaxially with one another, which drive shafts are coupled with one another by means of a coupling piece, in a force-locking manner. The coupling piece is thereby constituted in the form of a hollow shaft and is connected with the free drive shaft ends of the two hydraulic pumps by means of a spline/groove toothing. The coupling piece is surrounded by a connection piece which accommodates the suction channels and pressure channels leading to the hydraulic pumps. The double pump unit known from DE-OS 33 24 583 draws the pressure medium to be delivered directly out of a low-pressure line, without previously subjecting the pressure medium to a pre-compression. Thereby, the efficiency of the known double pump unit is limited and additionally there exists a danger of damage due to cavitation in the suction channel.

In order to counter this danger, it is on the other hand known from DE-PS 30 18 711 to connect a charging pump upstream of a hydraulic pump. The charging pump consists of an impeller formed in the manner of a turbine, which rotates in a correspondingly formed chamber.

SUMMARY OF THE INVENTION

Starting from DE-OS 33 24 583, the object of the present invention is to so further develop a hydrostatic double pump unit that a charging pump is integrated in a manner more simple in terms of construction and more cost effective.

Corresponding to the solution in accordance with the invention, there is provided in the connection piece an inlet pressure chamber into which the suction channels open out. The coupling piece has peripherally arranged blade elements which rotate in the inlet pressure chamber and thus feed the pressure medium into the suction channels under an initial pressure.

Thereby, the invention is based on the insight that the coupling piece, which is in any event already present and rotates with the drive shafts, can be employed as impeller for the charging pump when a corresponding inlet pressure chamber is provided in the connection piece and the coupling piece is provided with corresponding blade elements. This solution requires only a slight additional constructional outlay and is therefore particularly economical.

The connection piece may be formed in two parts, consisting of a main body and a lid-like closure part which closes the main body. Thereby, the coupling piece, with its blade elements, can be introduced into the main body of the connection piece through a correspondingly dimensioned opening in the main body, which opening can be closed by means of the closure part. This makes possible a particularly simple assembly and servicing of the coupling piece constituted as an impeller. Thereby, the connection piece can also accommodate the suction channel and pressure channel leading to the neighbouring hydraulic pump.

In a particularly advantageous manner, the coupling piece, including its blade elements, can be formed as a one-piece impeller.

Further, the coupling piece can be manufactured as a hollow shaft and be connected with the free ends of the driving shafts of the hydraulic pumps, by means of a spline/groove toothing.

The suction channels leading to the hydraulic pumps can either, open out into a common suction opening in the inlet pressure chamber and branch off to the two hydraulic pumps above, in the direction of flow, the suction opening, or there may be provided for each suction channel a separate suction channel opening. Correspondingly, the coupling piece can be formed as an impeller solely at one of its ends, by the arrangement of the blade elements, or, it can be formed in impeller shape symmetrically at both ends.

BRIEF DESCRIPTION OF THE DRAWINGS

Below, the invention will be described in more detail with reference to the drawings, which show.

DETAILED DESCRIPTION OF PREFERRED EMBODIMENTS

Figure 1:
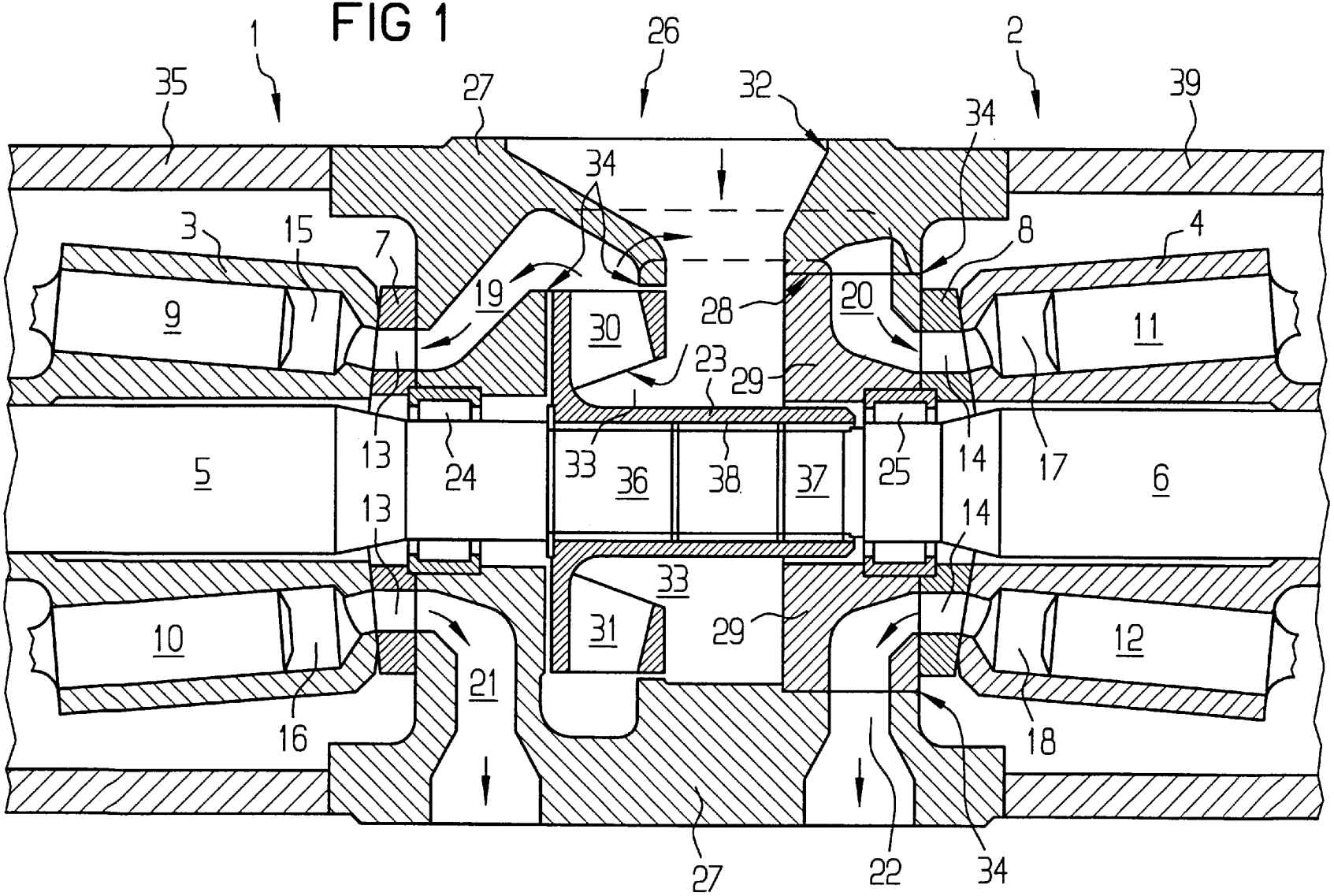
FIG. 1 a section through a first exemplary embodiment of the invention.

FIG. 1 shows an axial section through a first exemplary embodiment of the double pump unit further developed in accordance with the invention. The double pump unit includes two hydraulic pumps 1 and 2, which in the present exemplary embodiment are constituted as axial piston pumps and which are each enclosed by a respective housing 35 and 39. The basic construction of axial piston pumps is known, so that in the illustrated exemplary embodiment merely the cylinder drums 3, 4, the drive shafts 5, 6 and the control disks 7, 8 are illustrated. Pistons 9, 10 or 11, 12 are movably arranged in the cylinder drums 3, 4 and are supported in each case on a swash plate (not shown). The control disks 7, 8 have control channels 13, 14, formed in kidney-shape, which alternately connect the cylinder bores 15, 16 or 17, 18 formed in the cylinder drums 3, 4 with the suction channel 19 or 20 and the pressure channel 21 or 22. The drive shafts 5 and 6 of the two axial piston pumps 1 and 2 are connected with one another in a force-locking manner by means of a coupling piece 23 to be described in more detail below. One of the two drive shafts 5 or 6 is driven by a drive device (not shown) at its free end (likewise not shown), so that the cylinder drums 3 and 4 connected with the drive shafts 5 and 6 are set in rotation.

The drive shafts 5 and 6 are mounted in roller bearings 24 and 25 on a connection piece 26 to be described below. The connection piece 26 consists, in the illustrated exemplary embodiment, of a main body 27 having an axial, preferably circular opening 28, which can be closed by means of a closure part 29.

The coupling piece 23 has, in accordance with the invention, peripherally arranged blade elements 30, 31. The blade elements 30, 31 are distributed over the entire periphery of the coupling piece 23 in uniform radial spacing. The coupling piece 23 is therefore formed at one end as an impeller or turbine by means of the provision of the blade elements 30, 31. The blade elements 30, 31 thereby extend, in the exemplary embodiment illustrated in FIG. 1, substantially perpendicularly to the axis of the drive shafts 5, 6 of the hydraulic pumps 1, 2.

The pressure medium to be delivered by the double pump unit flows via a suction connection 32, formed in the shape of a funnel, into the inlet pressure chamber 33 provided in accordance with the invention, in which chamber the blade elements 30, 31 of the coupling piece 23 rotate during the operation of the hydraulic pumps 1 and 2. The blade elements 30, 31 thereby effect a pre-compression of the pressure medium, so that the pressure medium to be delivered is fed under an initial pressure into the suction channels 19, 20. By means of the initial pressure in the suction channels 19, 20 the efficiency of the hydraulic pumps 1 and 2 is increased and at the same time the danger of cavitation damage in the region of the suction channels 19, 20 or of the control channels 13, 14 is avoided.

In the exemplary embodiment according to FIG. 1, both suction channels 19 and 20 open into a common suction channel opening 34 in the inlet pressure chamber 33. Above, in the direction of flow, the suction channel opening 34, the suction channels 19 and 20 branch off each to one of the two hydraulic pumps 1 and 2. Thereby, the suction channel 20 is led through the main body 27 of the connecting piece 26 below the sectional plane of FIG. 1 and then so led through the closure part 29 that it reaches the control channels 14 of the control disk 8. On the outflow side, the pressure channel 21 of the hydraulic pump 1 is led through the main body 27 of the connection piece 26, whilst the pressure channel 22 of the hydraulic pump 2 is led both through the main body 27 and also through the closure part 29. For clarity, the direction of flow of the pressure medium is indicated by corresponding arrows.

In the exemplary embodiment according to FIG. 1, the closure part 29 is so formed that the coupling piece 23 together with the blade elements 30, 31 can be axially introduced through the opening 34 in the main body 27 of the connection piece, which opening 34 can be closed by means of the closure part 29. This significantly facilitates the assembly of the double pump unit.

The assembly can thereby be effected in the following steps:

Initially, the main body 27 of the connection piece 26 is connected with the housing 35 of the hydraulic pump 1. Then, the coupling piece 23, with the blade elements 30, 31, is inserted through the opening 34. Thereby, it is particularly advantageous if the coupling piece 23 is formed as a hollow shaft which at its inner diameter has a spline/groove toothing 38 which engages into a corresponding spline/groove toothing at the free end 36 of the drive shaft 5 of the hydraulic pump 1. Then, the opening 34 in the main body 27 of the connection piece 26 can be closed by means of the closure part 29. Subsequently, the second hydraulic pump 2 can be applied to the connection piece 26 whereby advantageously the free end 37 of the drive shaft likewise has a spline/groove toothing, which engages into the corresponding spline/groove toothing 38 on the inner diameter of the coupling piece 23.

The two-part configuration of the connection piece 26, with a main body 27 manufactured in one piece and with the closure part 29, thereby makes possible a guiding of the suction channels 19, 20 which is favourable in terms of flow, and makes possible a rapid assembly with little constructional outlay. By means of the further development of the coupling piece 23 with the blade-like elements 30, 31, there is achieved an effective charging pump.

The one-piece manner of construction of the main body 27 of the coupling piece 26 moreover offers further substantial advantages. Thus, the constructional length and the weight of the double pump unit can be significantly reduced in comparison with known configurations, and there can be attained largely a freedom from leakage, since no exterior sealing is necessary. The outer surface of the main body 27 of the connection piece 26 is available without restriction for the attachment of further means, e.g. the regulator, setting elements, or for connection threads and the like. Within the main body 27 there may be integrated further cylinder bores, oil supply bores, threads, etc.

Figure 2:
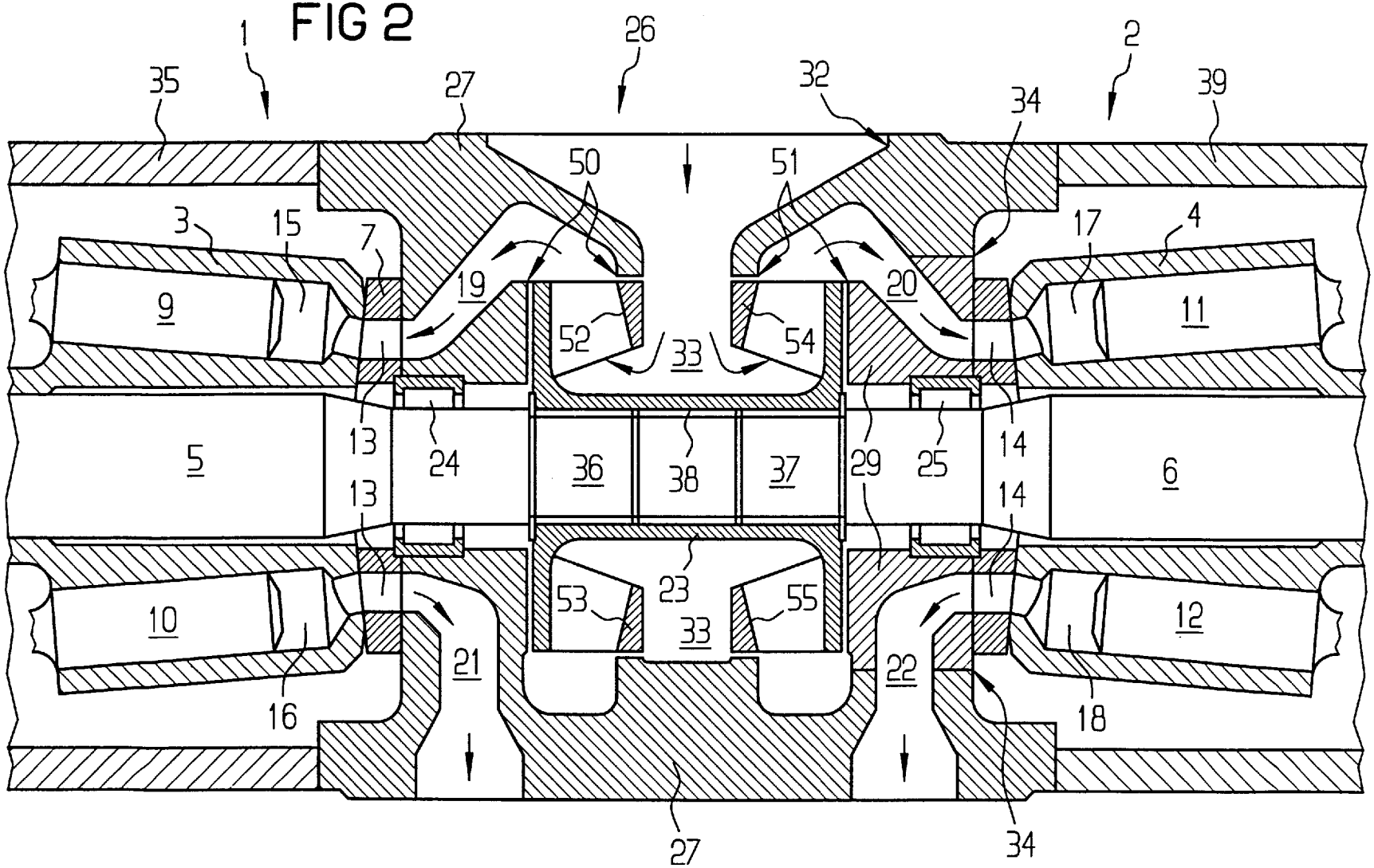
FIG. 2 a section through a second exemplary embodiment of the invention.

FIG. 2 shows a further exemplary embodiment of the double pump unit in accordance with the invention. The components already described with reference to FIG. 1 are provided with corresponding reference signs, so that a description thereof is not necessary.

Differently from the exemplary embodiment of FIG. 1, in the exemplary embodiment of FIG. 2, the suction channels 19 and 20 open into separate suction channel openings 50, 51, in the inlet pressure chamber 33. The coupling piece 33 has at both ends respective blade elements 52, 53 or 54, 55 which are arranged, as with the exemplary embodiment of FIG. 1, peripherally on the coupling piece 33, in radially uniform spacings, in the manner of an impeller or a turbine. In the exemplary embodiment of FIG. 2 there is thus associated with each suction channel 19 and 20 a separate impeller or turbine consisting of the blade elements 52, 53 or 54, 55, which in each case effects a pre-compression of the pressure medium to be delivered and feeds the pressure medium under an initial pressure into the respective suction channel 19 or 20. The distribution to the suction channels 19 and 20 thus is already effected in the inlet pressure chamber 33.

The symmetrical form according to FIG. 2 has the advantage of an increased efficiency for the charging pump consisting of the blade elements 52 to 55, so that a higher initial pressure is available in the suction channels 19 and 20. Beyond this, the symmetrical constitution of the suction channels has the advantage that the suction channel 20 on the right in the drawings has a lesser length, which is of advantage from the point of view of flow.

Of course, the invention is not restricted to the illustrated exemplary embodiments. Thus, the blade elements 30, 31 or 52 to 55 can be constructed in any other manner. In particular, the blade elements can be assembled together to a turbine which delivers parallel to the axial direction of the drive shafts 5 and 6 so that the suction channels 19 and 20 can be formed largely without bends. Further, the closure part 29 can also be arranged radially in order to make possible the introduction of the coupling piece 23 into the main body 27 of the connection piece 26 in a radial direction. Of course, the present invention can be employed not only in the case of an axial piston pump, but also with any other known hydrostatic pump, in particular a radial piston pump.

I claim:

1. Double pump unit having two hydraulic pumps (1, 2) having drive shafts (5, 6) arranged coaxially with one another, which shafts are coupled with one another in a force-locking manner by means of a coupling piece (23), in which connection piece suction channels (19, 20) for drawing in the pressure medium to be delivered through the hydraulic pumps (1, 2) are formed, wherein the connection piece (26) has an inlet pressure chamber (33) into which the suction channels (19, 20) open, and in that the coupling piece (23) has peripherally arranged blade elements (30, 31; 52–55) which rotate in the inlet pressure chamber (33) in order to feed the pressure medium into the suction channels (19, 20) under an initial pressure, the connection piece (26) is formed in two parts and, along with a main body (27) has a lid-like closure part (29) which is so formed that the coupling piece (23), with its blade elements (30, 31; 52–55). can be introduced into the main body (27) of the connection piece (26) through an opening (34) which can be closed by means of the closure piece (29).

2. Double pump unit according to claim 1, characterised in that, the connection piece (26) further has pressure channels (21, 22) for the discharge of the pressure medium.

3. Double pump unit according to claim 2, characterised in that, the suction channel (20) and selectively the pressure channel (22) of one of the two hydraulic pumps (2) is led through the closure part (29).

4. Double pump unit according to claim 1, characterised in that, the coupling piece (23), including its blade elements (30, 31; 52–55), is formed in one piece.

5. Double pump unit according to claim 1, characterised in that, the coupling piece (23) is formed as a hollow shaft, which surrounds the ends of the drive shafts (5, 6) of the hydraulic pumps (1, 2) in the manner of a sleeve.

6. Double pump unit according to claim 5, characterised in that, the coupling piece (23) is connected with the drive shafts (5, 6) of the hydraulic pumps (1, 2) by means of a spline/groove toothing (38).

7. Double pump unit according to claim 1, characterised in that, the suction channels (19, 20) leading each to one of the two hydraulic pumps (1, 2) open into a common suction channel opening (34) in the initial pressure chamber (33) and branch off above, in the direction of flow, the suction channel opening (34).

8. Double pump unit according to claim 7, characterised in that, the blade elements (30, 31) are provided at one end of the coupling piece (23) in the region of the suction channel opening (34).

9. Double pump unit according to claim 1, characterised in that, the suction channels (19, 20) leading each to one of the two hydraulic pumps (1, 2) open into separate suction channel openings (50, 51) in the initial pressure chamber (33).

10. Double pump unit according to claim 9, characterised in that, the blade elements (52–55) are provided at both ends of the coupling piece (23), in each case in the region of a suction channel opening (50, 51).

* * * * *